US008193105B2

(12) United States Patent
Goldberg

(10) Patent No.: US 8,193,105 B2
(45) Date of Patent: Jun. 5, 2012

(54) ALLERGEN BARRIER FABRIC

(75) Inventor: Gary Goldberg, Barrington, RI (US)

(73) Assignee: CleanBrands, LLC, East Providence, RI (US)

( * ) Notice: Subject to any disclaimer, the term of this patent is extended or adjusted under 35 U.S.C. 154(b) by 1326 days.

(21) Appl. No.: 11/583,356

(22) Filed: Oct. 19, 2006

(65) Prior Publication Data

US 2008/0096450 A1 Apr. 24, 2008

(51) Int. Cl.
*B32B 5/18* (2006.01)

(52) U.S. Cl. ..... 442/77; 442/181; 442/304; 428/315.7; 428/315.9

(58) Field of Classification Search ..... 442/77, 442/181, 304; 428/315.7, 317.9
See application file for complete search history.

(56) References Cited

U.S. PATENT DOCUMENTS

| | | | |
|---|---|---|---|
| 2,963,715 | A | 12/1960 | Young |
| 3,591,875 | A | 7/1971 | Zipf et al. |
| 4,670,073 | A | 6/1987 | Langley |
| 4,683,593 | A | 8/1987 | Langley |
| 4,704,753 | A | 11/1987 | Lunt |
| 4,803,116 | A | 2/1989 | Amano et al. |
| 4,809,375 | A | 3/1989 | Bull |
| 4,833,010 | A | 5/1989 | Langley |
| 4,846,822 | A | 7/1989 | Foxman |
| 4,938,817 | A | 7/1990 | Langley |
| 5,050,256 | A | 9/1991 | Woodcock |
| 5,169,697 | A | 12/1992 | Langley et al. |
| 5,321,861 | A | 6/1994 | Dancey et al. |
| 5,325,555 | A | 7/1994 | Whitley |
| 5,375,275 | A | 12/1994 | Sanders |
| 5,409,761 | A | 4/1995 | Langley |
| 5,424,117 | A | 6/1995 | Heiman et al. |
| 5,560,974 | A | 10/1996 | Langley |
| 5,869,193 | A | 2/1999 | Langley |
| 5,950,264 | A | 9/1999 | Wyner et al. |
| 5,966,759 | A | 10/1999 | Sanders et al. |
| 6,017,601 | A | 1/2000 | Amsel |
| 6,174,584 | B1 | 1/2001 | Keller et al. |
| 6,325,127 | B1 | 12/2001 | Waldrop |
| 6,363,553 | B1 | 4/2002 | Baumgärtel et al. |
| 6,381,778 | B1 | 5/2002 | Peterson |
| 6,618,880 | B1 | 9/2003 | Chase |
| 6,631,529 | B1 | 10/2003 | Erickson |

(Continued)

FOREIGN PATENT DOCUMENTS

DE 296 18 614 U1 2/1997

(Continued)

OTHER PUBLICATIONS

Wellington Sears Handbook of Industrial Textiles, pp. 625-626, 1995.*

(Continued)

*Primary Examiner* — Elizabeth Cole
(74) *Attorney, Agent, or Firm* — Wolf, Greenfield & Sacks, P.C.

(57) ABSTRACT

An allergen-barrier fabric and method of producing the same is provided. The fabric is formed from weaving yarns and processed such that the resulting pore size is less than approximately 1 micron. The finished fabric may also include exhibit consistent pore to pore variability. The finished fabric may exhibit an MVTR of at least 7,000 and a hydrostatic resistance of at least 10,000 mm.

17 Claims, 12 Drawing Sheets

U.S. PATENT DOCUMENTS

| | | | | |
|---|---|---|---|---|
| 6,634,042 | B2 | 10/2003 | Blossman | |
| 6,859,962 | B2 | 3/2005 | Diak/Ghanem | |
| 6,964,074 | B2 | 11/2005 | Carlitz | |
| 7,062,808 | B1 | 6/2006 | Brogden | |
| 7,181,797 | B2 | 2/2007 | Chase | |
| 2002/0148047 | A1 | 10/2002 | Corzani et al. | |
| 2004/0139552 | A1 | 7/2004 | Walters, Jr. | |
| 2005/0032446 | A1 | 2/2005 | Smith, III et al. | |
| 2006/0223401 | A1 * | 10/2006 | Chang | 442/181 |
| 2007/0067916 | A1 | 3/2007 | Poston | |
| 2008/0005845 | A1 | 1/2008 | Moran Pfleger | |

FOREIGN PATENT DOCUMENTS

| | | | | |
|---|---|---|---|---|
| EP | 1 806 073 | A1 | | 7/2007 |
| GB | 920166 | | | 3/1963 |
| JP | 62 117883 | A | | 5/1987 |
| KR | 2002034979 | A | * | 5/2002 |
| KR | 2002035012 | A | * | 5/2002 |
| WO | WO 91 19443 | A1 | | 12/1991 |
| WO | WO 01 36735 | A1 | | 5/2001 |
| WO | WO 03 064745 | A1 | | 8/2003 |
| WO | WO 2007/023256 | A1 | | 3/2007 |
| WO | WO 2007/042858 | A1 | | 4/2007 |

OTHER PUBLICATIONS

International Search Report and Written Opinion from a corresponding International Application No. PCT/US2007/019249, dated Jan. 2, 2008.

* cited by examiner

ALLERGEN BARRIER FABRIC

BACKGROUND

1. Field

Aspects of the invention relate to an allergen barrier and more particularly to a breathable waterproof fabric formed to resist allergen transmission.

2. Related Art

Many fabrics and sewn products have been touted as a solution for protection against allergens. However, such fabrics provide inadequate breathability and resistance to water penetration. In this regard, fabrics that do act as waterproof allergen barriers have poor breathability whereas fabrics with good breathability typically do not exhibit adequate resistance to water penetration or allergen resistance to allergen transmission. Breathable fabrics are typically formed with pores on the order of 10 microns. However, current literature and belief suggest that such a pore size would be ineffective at blocking many allergens, including dust mite feces, which are typically less than 3 microns. Further, such a large pore size does not provide suitable resistance to water penetration.

Another challenge with existing fabrics is the ability for the fabric to withstand sufficient tensile stress experienced with repeated use and laundering cycles.

To date, there is no product that has successfully united effective waterproofness with breathability and resistance to allergen transfer.

SUMMARY

In one embodiment, an allergen-barrier fabric is provided. The fabric includes a layer of a material formed from a yarn. The layer is adapted resist allergen transmission. The layer is finished to have a mean pore size of less than 1 micron.

In another embodiment, a method of making a fabric is provided. The method includes forming a layer of fabric in a manner resulting in pores through the layer, drying and shrinking the layer to reduce the pore size, and coating the layer to provide a finished pore size of less than approximately one micron.

In yet another embodiment, a protective cover is provided. A layer of woven or knitted fabric is formed from weaving yarns or knitting yarns, respectively. The layer thereby exhibits pores between adjacent individual or lines of yarns. A coating is formed on the layer of fabric. The pores of the coated layer collectively have a mean pore size of less than approximately one micron and a standard deviation of less than approximately one micron. The coated layer has an MVTR of at least approximately 7000 glm2/24 hr and a hydrostatic resistance of at least 10,000 mm based on a Suter test.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 1A:
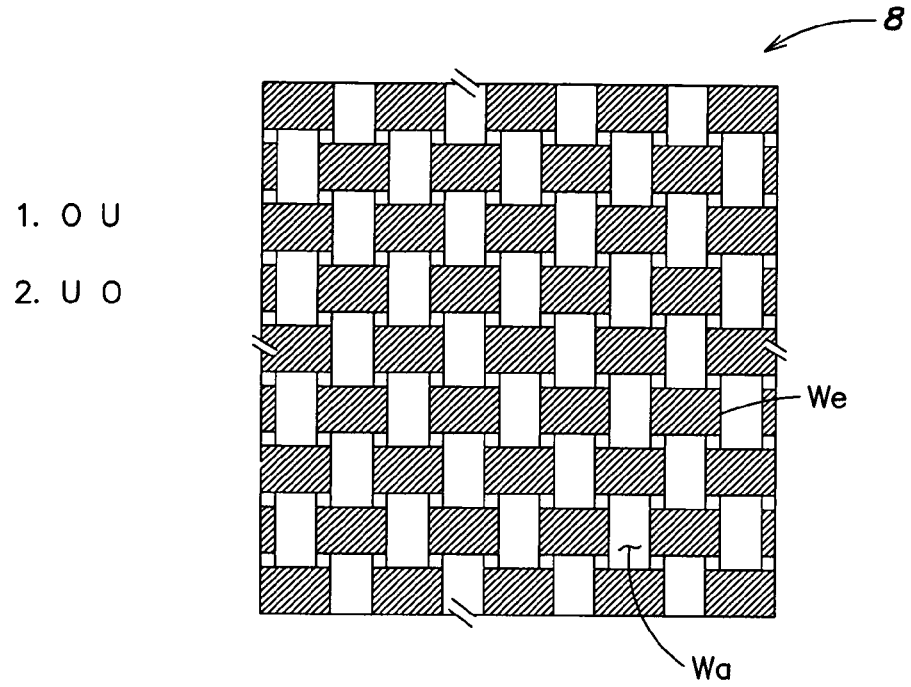
FIGS. 1*a*-1*g* are schematic representations of illustrative embodiments of various weave patterns.
Figure 1B:
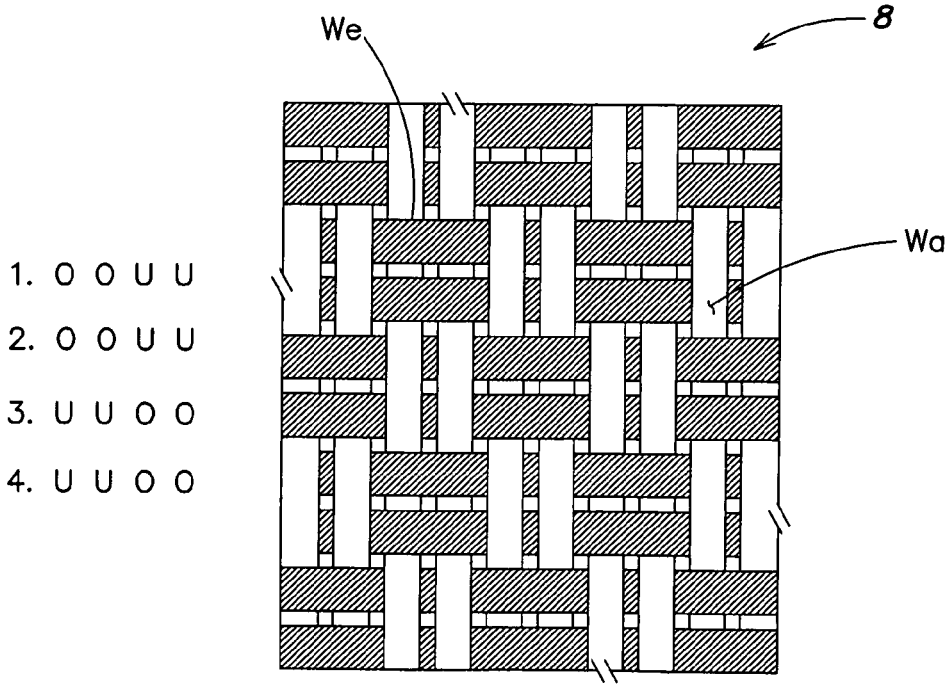

An allergen-barrier fabric and method of producing the same is provided. In one embodiment, the fabric is formed by weaving, knitting or otherwise forming the fabric such that the resulting pore size is capable of effectively reducing the transfer of allergens. Typical allergens include, but are not limited to, pet dander, pollen, mold spores, dust mites and dust mite feces, which can be as small as 1 micron. Thus, in one embodiment, the resulting mean pore size of the finished fabric has a mean of less than approximately 1 micron. In another embodiment, the mean pore size is approximately 0.5 microns. In another embodiment, the mean pore size is approximately 0.44 microns.

Although providing a fabric with such a small pore size would effectively reduce allergen transfer, in many instances it may be desirable to provide a fabric that exhibits good pore to pore consistency. Due to the unpredictable nature of textiles and the inconsistencies of various yarn qualities, a high standard deviation at a low confidence interval would increase the likelihood of outlying data points and thereby unfortunately afford the user a higher likelihood that allergens will pass through the protective layers of the fabric and come in contact with the user. Thus, the range of minimum and maximum pore size may be as important as the mean pore size itself. In this regard, consistency of the pore size, that is, pore-to-pore size differences, on a given area of fabric, aids in filtering allergens. Thus, the standard deviation obtained in embodiments of the present invention exhibits a very high confidence level. Employing the exemplary embodiments of the fabric and processes described herein, a finished fabric with a pore size standard deviation of less than 1 micron may be obtained. In another embodiment, the standard deviation is approximately 0.15 microns. In another embodiment, the standard deviation is approximately one-tenth of a micron. This low standard deviation in conjunction with a low mean is a unique characteristic of embodiments of the fabric of the present invention. In some embodiments, the standard deviation of tested samples exhibited a standard deviation of 0.15 microns, a mean of 0.44 microns and a maximum pore size of 0.625 microns. In this regard, with a mean pore size of less than approximately 1 micron, with such a controlled and tight tolerance, even with a maximum deviation, in one embodiment, the resulting pore size remains less than 1 micron. The benefit of a small standard deviation (or consistent pore size) is found when examining multiple yards of fabric.

The fabric may exhibit good breathability rendering the fabric more comfortable for a user. In this regard, breathability may be considered as the ability of the fabric to wick moisture away from the user's skin such that the user feels dry. In one embodiment, the finished fabric exhibits a breathability having an MVTR of at least approximately 7,000. As is known in the art, MVTR (also referred to as "moisture vapor transmission rate") represents the amount of water vapor (expressed in mass or weight) per unit area of the specimen over a period of time. Typical units are grams/meter$^2$ over a 24 hr period.

The ability of the fabric to resist water penetration may also be a desirable characteristic. However, as explained, balancing the often competing criteria of breathability and water resistance can be difficult. In one aspect of the invention, the finished fabric is formed such that it exhibits a hydrostatic resistance of at least 10,000 mm.

Figure 1C:
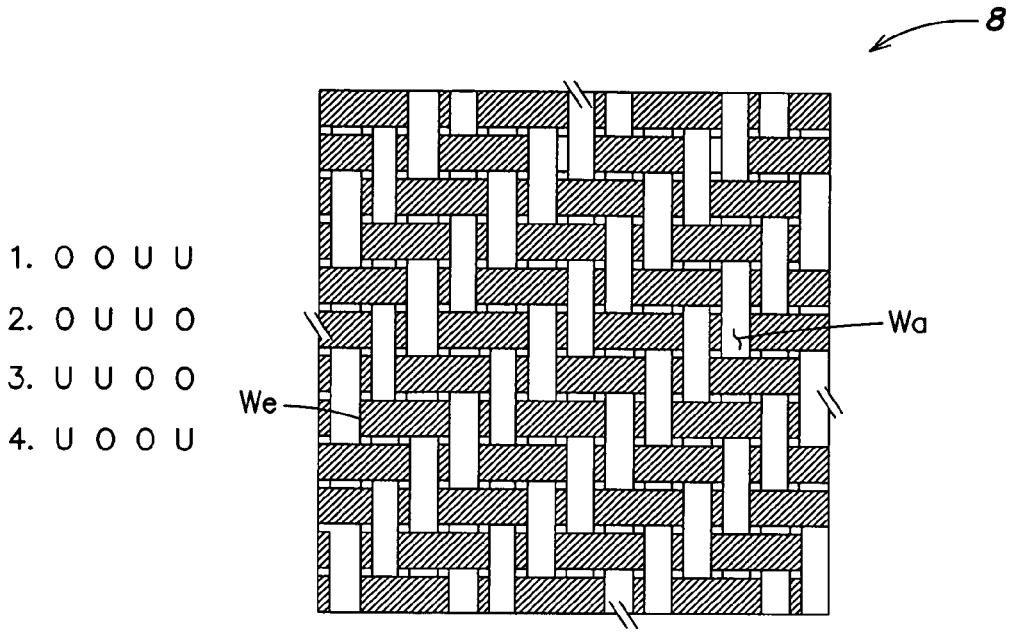
Figure 1D:
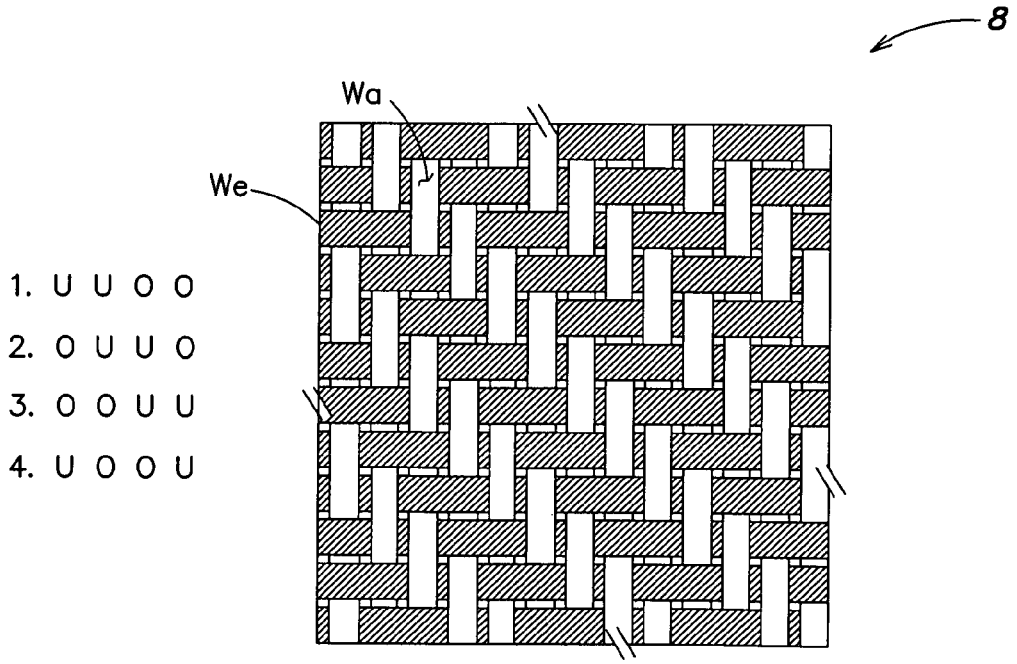
Figure 1E:
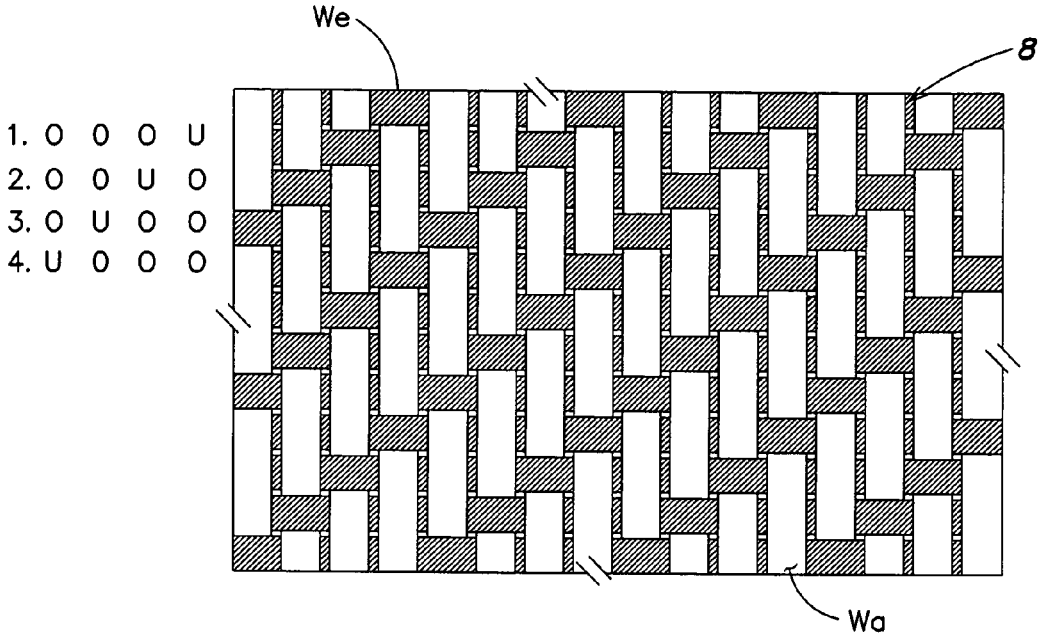
Figure 1F:
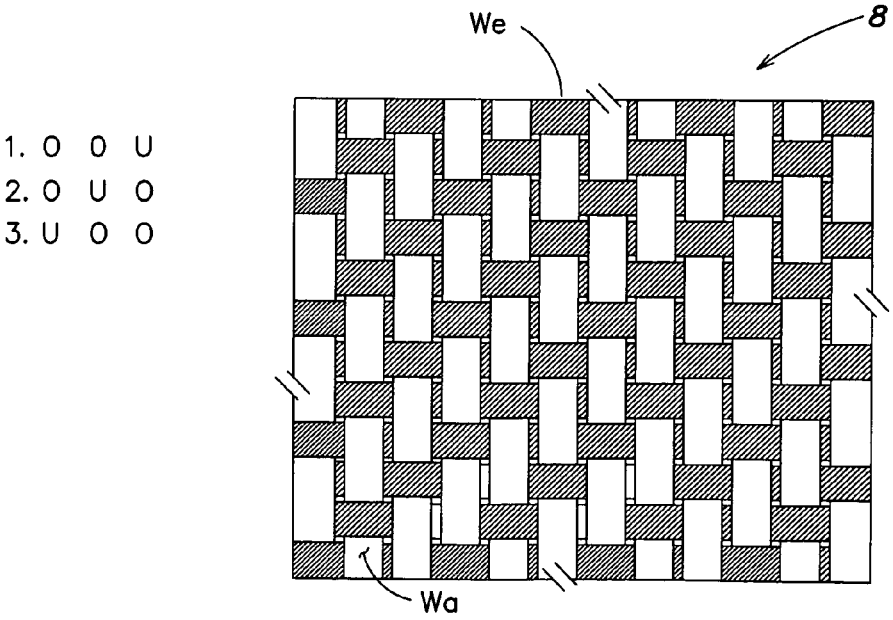
Figure 1G:
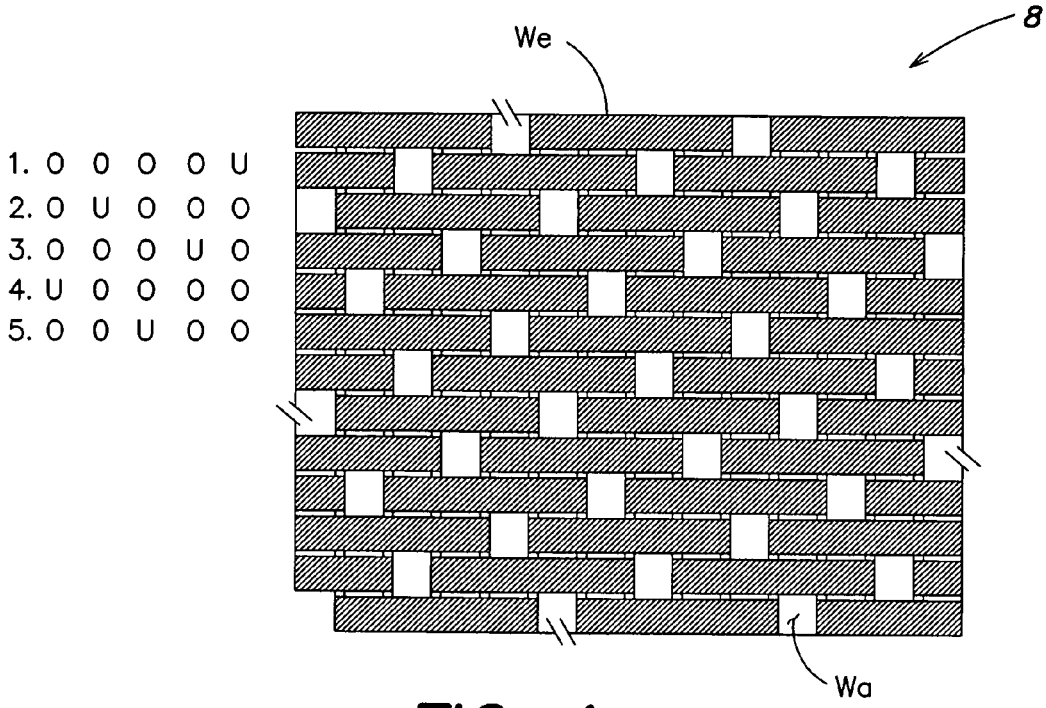

Turning now to the figures, and in particular to FIGS. 1*a*-1*g*, illustrative embodiments of a woven fabric 8 are shown, along with the representative over ("O") and under ("U") tables associated with the particular weave. Yarns of any suitable material are woven together to produce a desired weave pattern. In the example shown in FIG. 1*a*, a plain weave (also referred to as a "tabby" or "linen weave") is illustrated wherein warp "Wa" and weft "We" yarns in a typical alternating over and under fashion is employed. It should be appreciated, however, that the present invention is not limited in this regard, as other weaving patterns or combinations of weaving patters may be employed to form the fabric. For example, in the embodiment shown in FIG. 1*b*, two strands or threads in a side-by-side relationship, such as may be used in a basket weave, may be employed. Twill patterns may also be employed, where each weft thread proceeds in the same over/under pattern, but is offset by one thread from the previous weft thread. The under/over pattern of the twill is usually noted by two numbers with a slash between them, like 3/1. The number before the slash represents the quantity of threads a warp thread goes over, and the number after the slash is the amount of threads a warp thread goes under. Examples of such twill patterns are shown in FIG. 1*c* (showing a 2/2 Twill in a Z-wale pattern); FIG. 1*d* (showing a 2/2 Twill, S-wale); FIG. 1*e* (showing a 1/3 Twill, Z-wale); and FIG. 1*f* (showing a 1/2 Twill, Z-wale). FIG. 1*g* represents another alternative weave pattern, wherein a satin weave is used. Satin weaves typically employ continuous weft yarn, with few interruptions of the warp yarn. Furthermore, although woven fabrics are shown and described, knitted fabrics may be employed, as the present invention is not so limited. In this regard, it should be appreciated that the invention is not limited to any particular way of producing a fabric from yarns or threads. Thus, any fabric formed in a manner resulting in pores between adjacent individual threads or yarns (in the case of a woven fabric) or adjacent lines of threads or yarns (in the case of a knitted fabric) may be employed, as the present invention is not limited in this regard. As used herein, the term "yarn" or "yarns" may be used interchangeably with "thread" or "threads" respectively, as the present invention is not limited in this regard.

Figure 2:
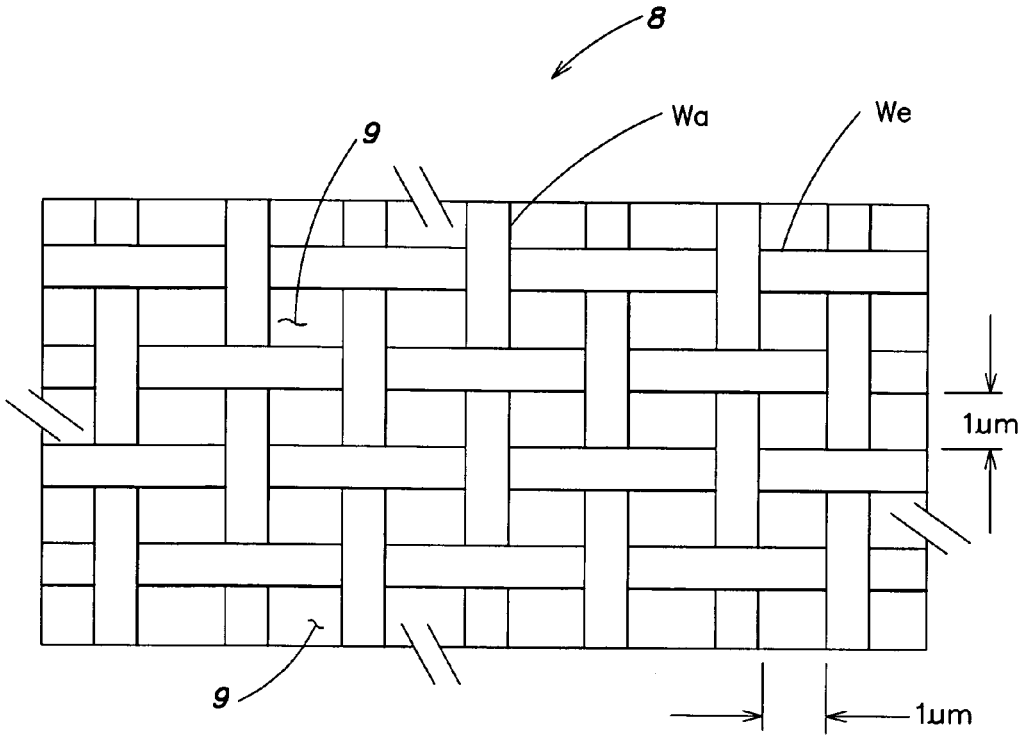
FIG. 2 is a schematic of a simple weave showing an illustrative pore size.

A schematic representation of one example of a completed fabric woven or knitted or otherwise formed with pores 9 is shown in FIG. 2. In this example, a simple, i.e., plain, weave is shown. As illustrated, the pore size, that is, the spacing between parallel weft "We" yarns and/or the spacing between parallel warp "Wa" yarns, is approximately less than 1 micron (1 μm). Further, as discussed above, the pore to pore variability is less than approximately 1 μm and in one embodiment, less than approximately one tenth of a micron (0.1 μm). Of course, similar pore sizes and pore to pore variability may be employed in other suitable weave patterns, as the present invention is not limited in this regard.

Figure 3:
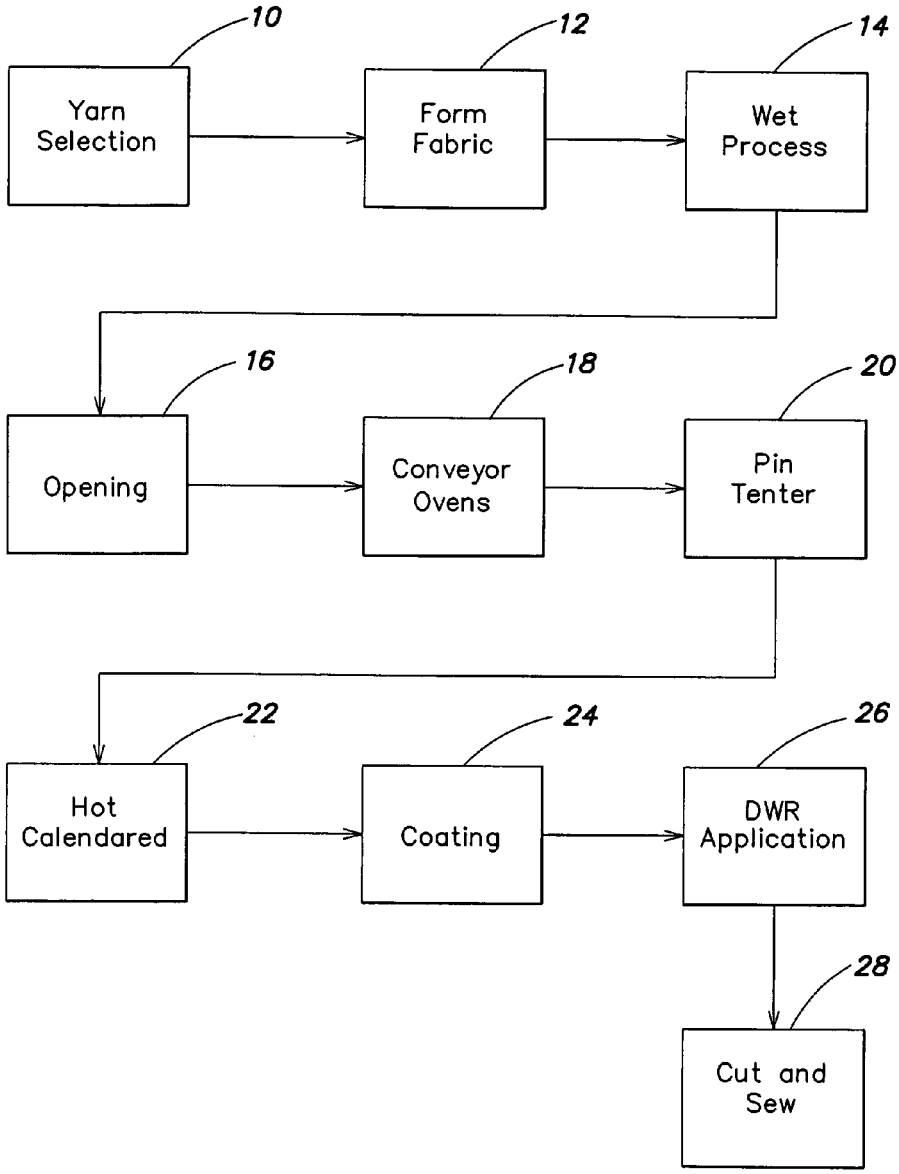
FIG. 3 is a schematic block diagram representing illustrative processes for forming a fabric.

Reference is now made to the block diagram of FIG. 3, which represents illustrative processes used to form the fabric. At Block 10, the yarn is selected and at Block 12, the yarn is woven, knitted, or otherwise formed in a manner resulting in pores formed in the fabric.

Figure 4:
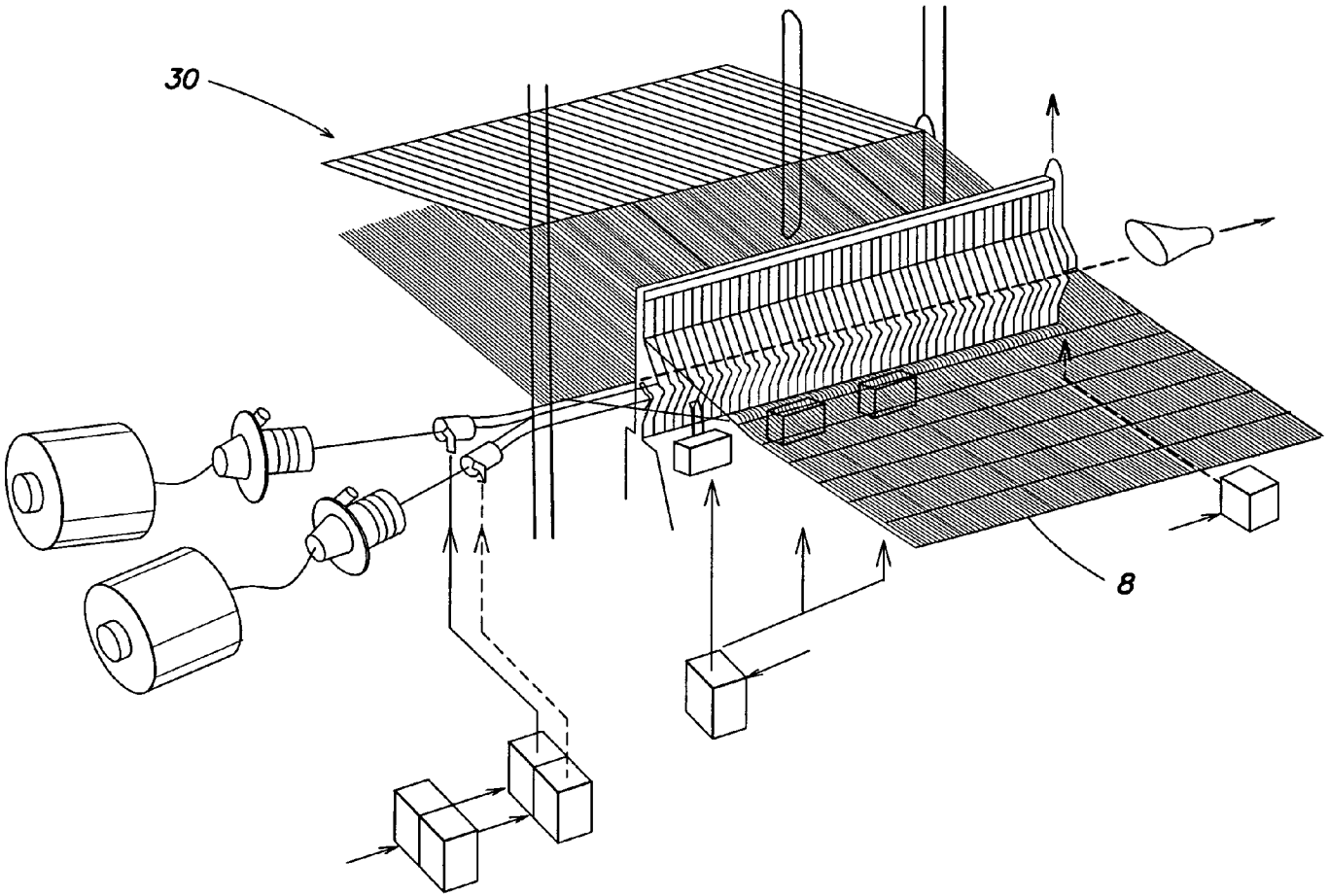
FIG. 4 is a schematic representation of an illustrative loom used with processing the fabric.

In one embodiment, the product is woven. Any suitable weaving equipment and any suitable yarn may be employed. In one embodiment, a 50 denier continuous polyester filament yarn is woven using a loom, such as an air jet loom. One commercially available air-jet loom is the Model JAT710 made by Toyota Industries Corporation of Japan. FIG. 4 is a schematic representation of such a loom 30.

It should be appreciated that other types of yarn materials and sizes and other types of looms or equipment may also be used, as the present invention is not limited in this regard. For example, synthetic yarns, such as the above-mentioned polyester, may be employed. Other synthetic yarns may also be employed. Natural fibers may also be employed, as the present invention is not limited in this regard. In one embodiment, the relatively small denier size aids in decreasing the vacant spaces in between the intersections of the yarns, and thus minimizing the pore size of the final product. By using a yarn that is considered very small in circumference, on the textile measurement scale of denier, the default vacant interstices 9 (see FIG. 2) between the yarns are small to begin with. The 50 denier continuous polyester filament yarn may be a Kolon Industries 50 denier flat semi dull 36 filaments yarn. Although 50 denier has been found to be preferred, similar results can be accomplished with deniers ranging from 30 to 150, as the present invention is not limited in this regard.

In one embodiment, the density of the weave is approximately 205 warp yarns and 160 weft yarns per square inch of fabric measured after all of the finishing processes have been completed. However, similar results can be achieved with a density in a range within 75-205 warp yarns and 90-175 filling or weft yarns per square inch. It should be appreciated that the present invention is not limited in this regard, as other suitable densities may be employed.

The greige width before wet processing off of the reed should be considered as this will affect the final width of the finished fabric. In one embodiment, the width off of the loom is at least 72" wide from selvedge to selvedge, although other widths may be employed, as the present invention is not limited in this regard.

Although it has been found that the above-mentioned construction and yarn choice may be an important first step in developing a product that has a predictable pore size across and along the fabric, other constructs and materials may be employed, as the present invention is not limited in this regard.

Although natural fibers such as cotton or wool may be employed in the present invention, synthetic yarns may be preferred in some embodiments due to the shape and width of each yarn being consistent as a result of the inherent nature of drawing synthetic filament fiber. In this regard, not only is the synthetic filament fiber small in circumference but it is very stable at high temperatures. The dimensional shrinkage has been found to be less than 0.25% in both the warp and fill direction after 100 industrial launderings at 165° Fahrenheit. Dimensional stability may be important in the processing of the raw materials as it allows consistent continuous application of additional processes further in the manufacturing steps.

Figure 5:
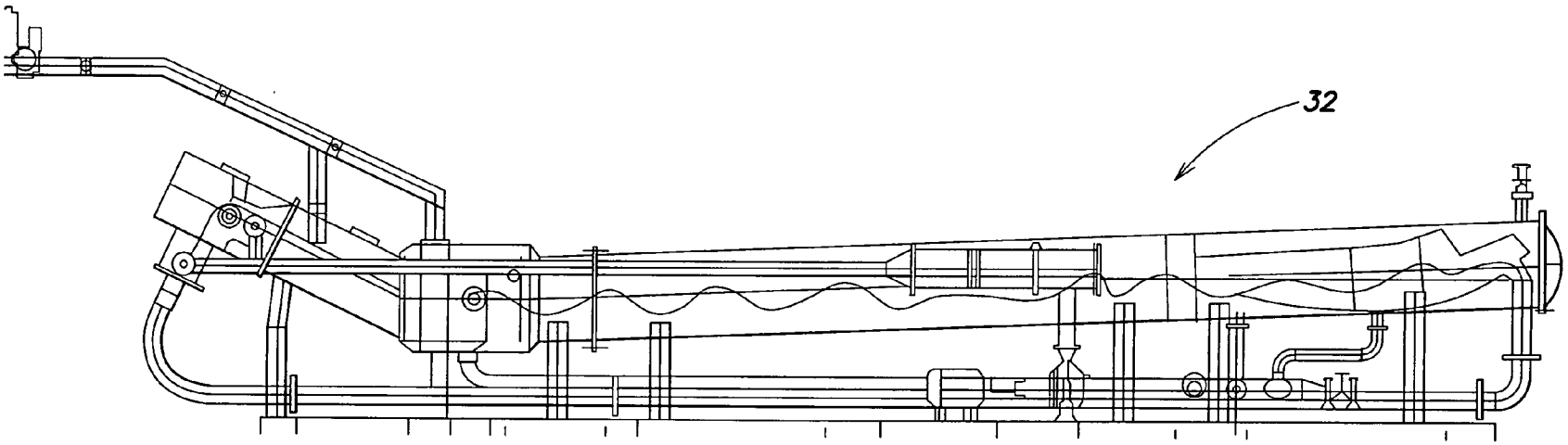
FIG. 5 is a schematic representation of illustrative dyeing equipment used with processing the fabric.

The polyester greige fabric is then wet processed, as shown in FIG. 3 at Block 14, in a manner to provide uniform shrinkage. In one embodiment, the dyeing process is performed using a soft flow dyeing vessel, which uses water pressure to move the fabric through the dye bath as opposed to mechanical tension. In addition, due to the high melt point of polyester, which is approximately 450° Fahrenheit, the bath should reach temperatures above atmospheric boiling points. That is, the both should reach above 212° Fahrenheit and in one embodiment, should reach approximately 275° Fahrenheit to insure that the fabric is completely shrunken and heat set. By using this method of wet processing, a consistently small pore size may be achieved. In this regard, aligning the yarns closely together through the compaction of the yarns due to shrinkage aids in producing the small pore size. While soft flow dyeing equipment is employed, similar results can be achieved using beam dyeing equipment or pressured jig dyeing equipment, or other suitable and/or known dyeing equipment, as the present invention is not limited in this regard. In one embodiment, a jet dyeing machine, such as one made by Gaston County Dyeing Machine Company of Stanley, N.C., model name Futura, may be used. FIG. 5 is a diagrammatic representation of one example of a jet dyeing machine 32. However, it should be appreciated that other suitable dyeing machines may be employed, as the present invention is not limited in this regard.

Figure 6:
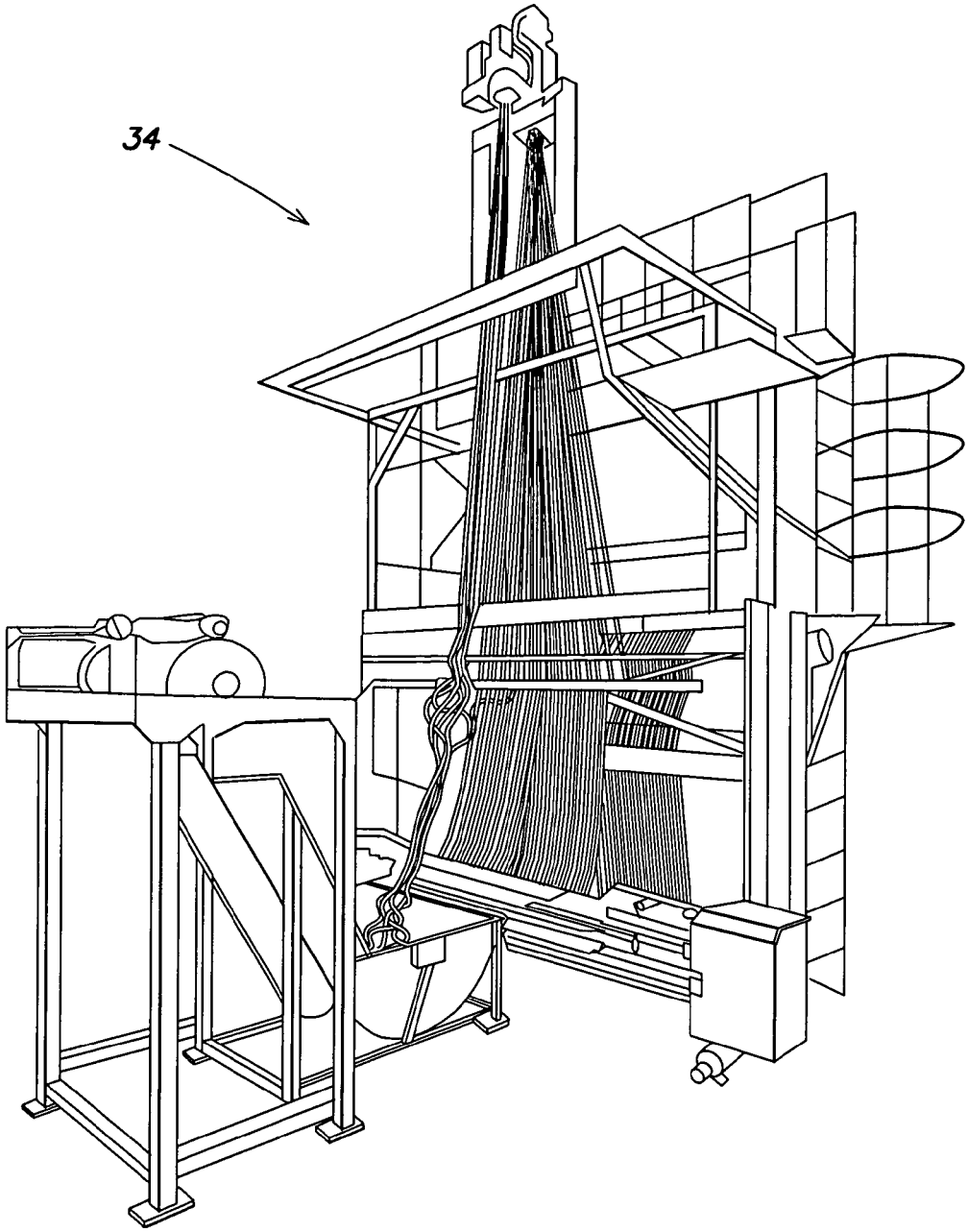
FIG. 6 is a schematic representation of an illustrative scutcher used with processing the fabric.

The fabric is then removed from the dyeing vessel, as represented by Block 16 in FIG. 3. In one embodiment, the fabric is removed in its rope wet form so as to not create or at least minimize any warp tension until the fabric has been dried in a non tension manner. In one embodiment, the rope form of the dyed fabric is then mechanically flapped open with a scutcher to begin to remove excess water and expose and align the fabric edges so that further drying can be accomplished. One example of a scutcher 34 is shown in FIG. 6. Of course, other suitable opening techniques may be employed, as the present invention is not limited in this regard.

Figure 7:
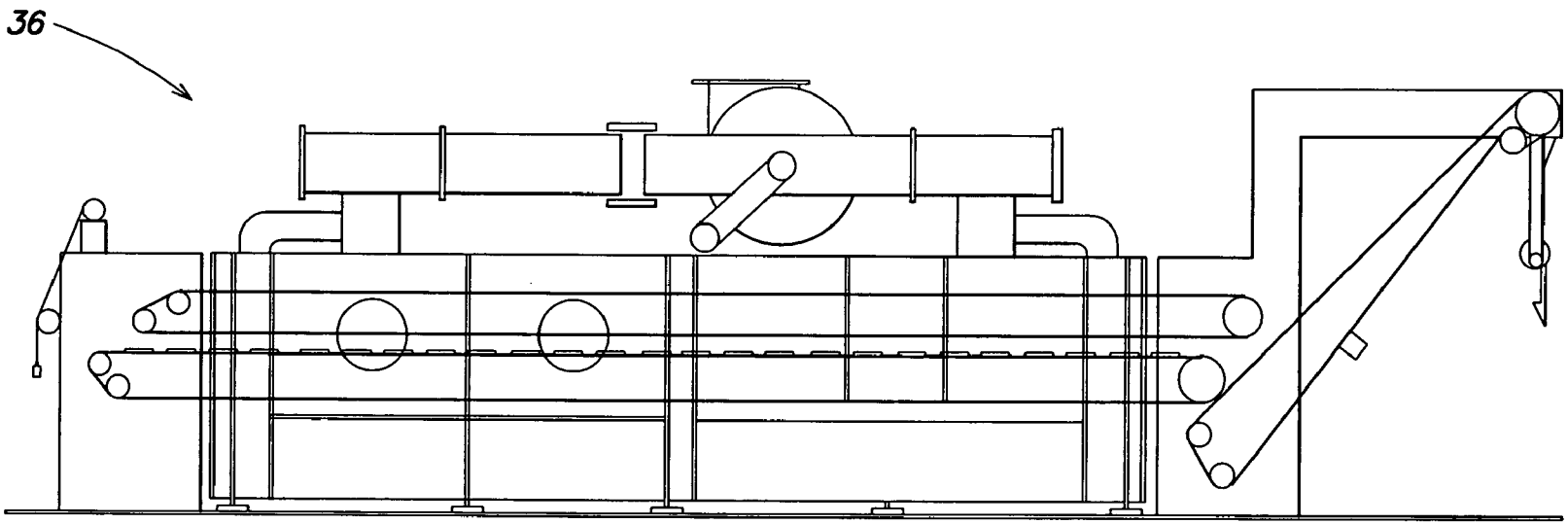
FIG. 7 is a schematic representation of an illustrative dryer used with processing the fabric.

As shown in Block 18, the fabric is then dried using, in one embodiment, a tensionless conveyor dryer with hot air impingement on either side of the face and back of the fabric. A multi stage conveyor dryer may be used, such as made by Dhall Enterprises & Engineering Limited of India, although other suitable dryers may be used, as the present invention is not limited in this regard. One example of such as dryer 36 is shown schematically in FIG. 7. In one embodiment, an open cell conveyor belt passing through several connected ovens (3, 8, 10, 12 or even 15 connected ovens) may be employed. The ovens are set at incrementally hotter temperatures to provide a controlled rate of drying and shrinkage, again aiding in maintaining a range of pore sizes which are more consistent in their size. In one embodiment, the first or first few ovens are set at approximately 150° F.-175° F., and the middle oven(s) is/are set to approximately 425° Fahrenheit. A surface temperature device may be used to measure the fabric's temperature while it is being dried on the conveyor. In one embodiment, the target surface temperature for the fabric is 405° Fahrenheit or just below the melting point of the fabric. As such, any suitable dryer arrangement whereby the desired surface temperature of the fabric is achieved may be employed, as the present invention is not limited in this regard.

Upon exiting the conveyor dryer, in one embodiment, the fabric is collected in a tub or basket of adequate width as to allow the fabric to collect in a ribbon candy like form, care being taken to use a collection device which is wider then the overall width of the fabric to avoid rolling the selvedge inward which later on can be difficult to remove. Of course, other suitable collection arrangements may be employed, as the present invention is not limited in this regard.

Figure 8:
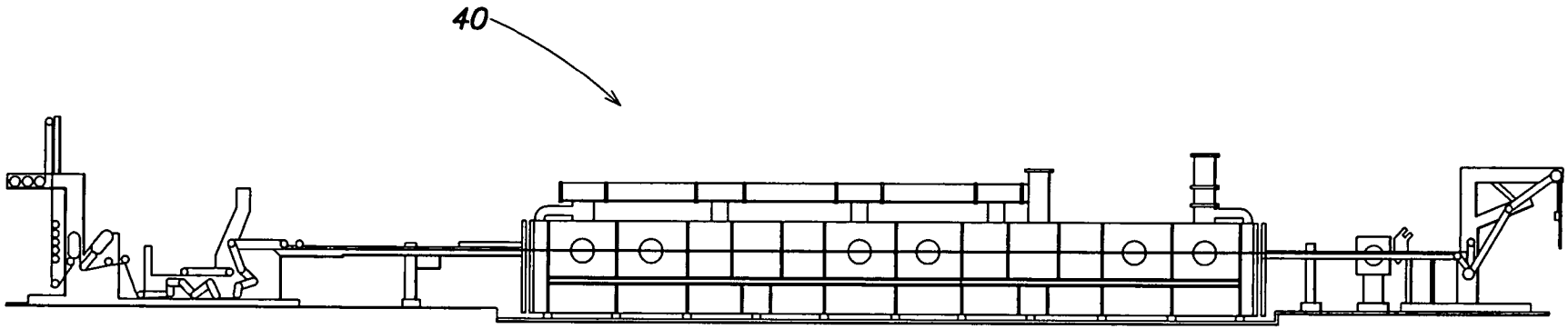
FIG. 8 is a schematic representation of an illustrative tenter frame used with processing the fabric.

In one embodiment, the fabric is then continuously dried again using a Tenter Frame fitted with extra fine pins on the rails, as opposed to a more traditional clip frame, as shown at Block 20 of FIG. 3. However, the present invention is not limited in this regard as other equipment, including a conventional clip frame may be employed. The Tenter Frame may also be provided by Dhall Enterprises & Engineering Limited. One example of such a Tenter Frame 40 is shown schematically in FIG. 8. In one embodiment, the Tenter Frame is equipped with a brush wheel overfeed where the fabric is introduced to the pins which carry the fabric down the rails and subsequently into the ovens. In one embodiment, the rails are not set any wider then 59" at any point in this tentering process. In one embodiment, the fabric remains tensionless at all times in all directions to insure minimum pore size and maximum shrinkage. As with the conveyer dryer, the oven temperatures should be set to 425° Fahrenheit with a target fabric surface temperature of 405° Fahrenheit. A fabric surface temperature device may be employed here as well. The wind up or take up roll may be a surface wind device and there may be a bow bar directly before the surface winding device. The surface winder is so as to avoid too much slack which can produce a messy finished roll. This stage of the process assists in removing any wrinkles from the fabric and prepares the fabric for further processing.

The fabric is then hot calendared, as shown at Block 22, using, in one embodiment, a minimum of 40 tons of pressure. Of course, other suitable pressures may be employed, as the present invention is not limited in this regard. This stage of the process typically creates a mean pore size of approximately 2-4 microns and a maximum pore size of approximately 8-9 microns. It has been observed that this pore size is superior to industry available products for filtration and moisture vapor transmission, but not necessarily to hydrostatic resistance (that is, the level of waterproof). Hot calendaring further aligns the yarns and compresses the normal cylinder shape of each yarn to a more elliptical shape yarn. A wider flatter yarn thereby further decreases the spaces between the yarns in the weave and thereby decreases the size of the pores and increases the hydrostatic resistance.

Continuing with reference to FIG. 3, at Block 24, the fabric is then coated using a conventional knife over roll method, although other suitable coating methodologies may be employed, as the present invention is not limited in this regard. At the completion of this part of the process, the fabric will have hydrostatic resistance in excess of 8,000 mm on the Suter scale, an MVTR of at least 7000 $g/m^2/24$ hr and a maximum pore size less than approximately 1 micron.

In one embodiment, the coating process is divided into three unique passes through the coating equipment, or if available a multi-head coating equipment may be used.

In one embodiment, the first or base coat chemistry to be applied has the following properties:

Solids of 44%+/−2%
Viscosity (Cps. 72° F.)=30,000
100% Tensile Modulus=400 PSI
Tensile Strength=1200 PSI
% Elongation=300%
Hydrostatic Resistance≧10,000 mm
MVTR≧7,000 upright In one embodiment, the total weight of the first base coat is approximately 0.75 oz per yard.

In one embodiment, the second coat to be applied should have the following properties:

Solids of 38%+/−2%

Viscosity (Cps. 72° F.)=12,000

100% Tensile modulus=2500 PSI

Tensile Strength=3400 PSI

% Elongation=130%

Hydrostatic Resistance≧10,000 mm

MVTR≧7,000 upright

In one embodiment, the total weight of the second coat is approximately 0.25 oz per yard.

In one embodiment, the third (which may be the final coat) has the same properties as the second coat; however an additional fire resistant or retardant ("FR") component may be added to improve the flammability rating for the fabric. Any suitable FR component may be employed, as the as the present invention is not limited in this regard.

Coatings exhibiting these properties may be obtained from any suitable source. For example, the coating may be obtained from the Soluol Corporation of West Warwick, R.I. Exemplary coatings include Solucote Base FR 565, Solucote Top FR 767, and Solucote Top 920.

As shown at Block 26 of FIG. 3, the fabric may then be treated with a durable water resistant or repellant ("DWR") finish on an industry standard clip Tenter frame. Any suitable DWR finish using any suitable application technique may be employed, as the present invention is not limited in this regard. However, in one embodiment, a DWR finish, such as Masurf DWR-150, available from Mason Chemical Company of Arlington Heights, Ill. may be used.

In one embodiment, the finished fabric will now exhibit the following unique properties.

Hydrostatic Resistance≧10,000 mm using the Suter test method

MVTR≧7,000 upright

Maximum Pore Size≦approximately 1 micron

Mean Pore Size=approximately 0.5 microns

Standard Deviation≦approximately 0.1 microns

Finished weight per yard=155 grams

Dimensional shrinkage after laundering<approximately 0.25%

Tensile Strength≧15 PSI

Although a fluid or fluid-like coating has been described, the present invention is not limited in this regard. Thus, in on embodiment, a laminate film coating may be applied to the surface of the fabric. In this embodiment, the laminate exhibits suitable characteristics, such as waterproofness, breathability and resistance to allergen transfer, to aid in maintaining or producing the desired characteristics of the final fabric product.

In one embodiment, the resulting fabric has the ability to maintain the above specifications after 100 cycles of laundering at 165° Fahrenheit and warm tumble dry. This characteristic may be important when using the product in commercial applications, such as hospitals or hotels, which typically expose laundry to a more aggressive wash/dry process.

The fabric is now ready to be cut and sewn, as shown at Block 28 of FIG. 3 and transformed into any suitable article, such as a mattress protector, pillow protector, and/or comforter/duvet protector. The finished product can be sewn in a manner which allows all surfaces of the item to be covered completely by the product. In one embodiment, a zippered closure (not shown) on one end of the product is employed to assist in closing the article and enclose the item contained therein.

Figure 9:
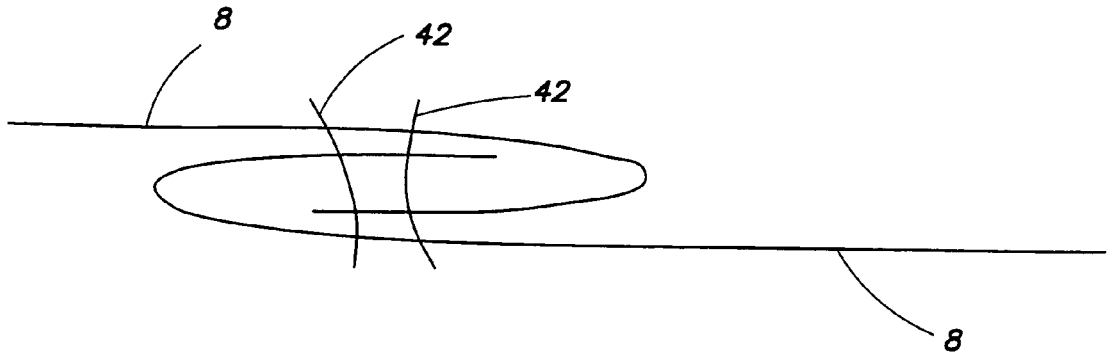
FIG. 9 is a schematic representation of an exemplary seam formed in the fabric upon producing an article.

In one embodiment, the seams are double folded to create 4 continuous layers of fabric 8 stitched together by threads 42, as shown in the schematic of FIG. 9. This reduces escape of allergens at any seam point. In addition, in some embodiments, seams can be sealed or taped over to add an even higher level of certainty that there will be no compromises to the article's ability to prevent and/or significantly reduce transmission of allergens from the inside covered item to the user. Other suitable techniques to reduce allergen transmission at seams may be employed, as the present invention is not limited in this regard.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the sprit and scope of the invention. Accordingly, the descriptions and drawings herein are by way of example only.

What is claimed is:

1. An allergen-barrier fabric, comprising:

a layer of a material formed from a yarn and that is adapted to resist allergen transmission;

said layer finished to have a mean pore size of less than 1 micron, wherein the fabric has been wet processed and dried at incrementally hotter temperatures so that a pore size standard deviation of less than 1 micron is achieved in said layer.

2. The allergen-barrier fabric of claim 1 wherein said layer exhibits an MVTR of at least 7,000 $g/m^2/24$ hr.

3. The allergen-barrier fabric of claim 1 wherein said yarn is a polyester continuous filament yarn.

4. The allergen-barrier fabric of claim 1 wherein said layer is formed of filaments of about 50 denier.

5. The allergen-barrier fabric of claim 1 wherein said layer is formed of filaments having a denier in a range between 30 denier and 150 denier.

6. The allergen-barrier fabric of claim 1 wherein said layer is woven and is formed with a density of weave of 205 warp yarns and 160 weft yarns.

7. The allergen-barrier fabric of claim 1 wherein said layer is woven and is formed with a density of weave of 75-205 warp yarns and 90-175 weft yarns.

8. The allergen-barrier fabric of claim 1 wherein the mean pore size is approximately 0.5 microns.

9. The allergen-barrier fabric of claim 1 wherein the mean pore size is approximately 0.44 microns.

10. The allergen-barrier fabric of claim 1 wherein said layer exhibits a pore size standard deviation of approximately 0.15 microns.

11. The allergen-barrier fabric of claim 1 wherein said layer exhibits a pore size standard deviation of approximately 0.10 microns.

12. The allergen-barrier fabric of claim 1 wherein said layer exhibits a maximum pore size of 0.625 microns.

13. The allergen-barrier fabric of claim 1 wherein the layer is a weave or a knit.

14. The allergen-barrier fabric of claim 1 wherein the layer is coated.

15. The allergen-barrier fabric of claim 1 in combination with an article adapted to cover an item, wherein the layer is formed into the article.

16. The allergen-barrier fabric of claim 1 wherein the standard deviation is less than approximately 0.15 microns.

17. The allergen-barrier fabric of claim 16 wherein the standard deviation is less than approximately 0.10 microns.

* * * * *